US009255305B2

(12) United States Patent
Kim et al.

(10) Patent No.: US 9,255,305 B2
(45) Date of Patent: Feb. 9, 2016

(54) HIGH-STRENGTH STEEL SHEET HAVING SUPERIOR TOUGHNESS AT CRYOGENIC TEMPERATURES, AND METHOD FOR MANUFACTURING SAME

(75) Inventors: Woo-Gyeom Kim, Pohang-si (KR); Sang-Ho Kim, Pohang-si (KR); Ki-Hyun Bang, Pohang-si (KR); In-Shik Suh, Pohang-si (KR)

(73) Assignee: POSCO, Pohang-si (KR)

( * ) Notice: Subject to any disclaimer, the term of this patent is extended or adjusted under 35 U.S.C. 154(b) by 276 days.

(21) Appl. No.: 13/997,703

(22) PCT Filed: Dec. 27, 2011

(86) PCT No.: PCT/KR2011/010156

§ 371 (c)(1),
(2), (4) Date: Jun. 25, 2013

(87) PCT Pub. No.: WO2012/091411

PCT Pub. Date: Jul. 5, 2012

(65) Prior Publication Data

US 2013/0292011 A1 Nov. 7, 2013

(30) Foreign Application Priority Data

Dec. 28, 2010 (KR) ..... 10-2010-0137340

(51) Int. Cl.
*C22C 38/02* (2006.01)
*C22C 38/04* (2006.01)
(Continued)

(52) U.S. Cl.
CPC ..... *C21D 8/005* (2013.01); *C21D 8/0205* (2013.01); *C21D 8/0226* (2013.01); *C21D 8/0247* (2013.01); *C21D 8/0263* (2013.01); *C21D 9/46* (2013.01); *C22C 38/00* (2013.01);
(Continued)

(58) Field of Classification Search
None
See application file for complete search history.

(56) References Cited

U.S. PATENT DOCUMENTS

| | | | |
|---|---|---|---|
| 2007/0193665 | A1 | 8/2007 | Furuya et al. |
| 2010/0074794 | A1 | 3/2010 | Ahn et al. |
| 2010/0258219 | A1 | 10/2010 | Ahn et al. |

FOREIGN PATENT DOCUMENTS

| | | | |
|---|---|---|---|
| CN | 1390960 | A | 1/2003 |
| CN | 101649420 | A | 2/2010 |
| DE | 2809795 | A1 | 9/1979 |
| EP | 1136580 | A1 | 9/2001 |
| EP | 1164204 | A1 | 12/2001 |
| EP | 1736562 | A1 | 12/2006 |

(Continued)

OTHER PUBLICATIONS

Yun Bo Xu et al: "Microstructural evolution in an ultralow-C and high-Nb bearing steel during continuous cooling", Journal of Materials Science, Kluwer Academic Pubkishers, BO, vol. 44, No. 15, May 24, 2009, pp. 3928-3935, XP019679878, ISSN:1573-4803.

*Primary Examiner* — Deborah Yee
(74) *Attorney, Agent, or Firm* — The Webb Law Firm

(57) ABSTRACT

According to one aspect, provided is a high-strength steel sheet having superior toughness at cryogenic temperature, comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the high-strength steel sheet satisfies the condition of [Mn]+5.4[Si]+26[Al]+32.8[Nb]<4.3 where [Mn], [Si], [Al], and [Nb] indicate contents of Mn, Si, Al, and Nb in weight percentage, respectively. The steel sheet secures toughness when used as structural steel materials for ships, offshore structures, or the like, or steel materials for tanks for storing and carrying liquefied gases, which are exposed to an extreme low temperature environment.

9 Claims, 1 Drawing Sheet

(51) Int. Cl.

| | |
|---|---|
| ***C22C 38/08*** | (2006.01) |
| ***C22C 38/16*** | (2006.01) |
| ***C22C 38/06*** | (2006.01) |
| ***C21D 8/02*** | (2006.01) |
| ***C21D 8/00*** | (2006.01) |
| ***C21D 9/46*** | (2006.01) |
| ***C22C 38/00*** | (2006.01) |
| ***C22C 38/12*** | (2006.01) |
| ***C22C 38/14*** | (2006.01) |

(52) U.S. Cl.

CPC ..... *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/005* (2013.01)

(56) References Cited

FOREIGN PATENT DOCUMENTS

| | | | |
|---|---|---|---|
| EP | 2006407 | A1 | 12/2008 |
| GB | 2361526 | A | 10/2001 |
| JP | 57-123927 | | 8/1982 |
| JP | 64-015319 | | 1/1989 |
| JP | 05-009651 | | 1/1993 |
| JP | 05-202444 | | 8/1993 |
| JP | 08-120338 | | 5/1996 |
| JP | 10-168542 | | 6/1998 |
| JP | 2000-008123 | | 1/2000 |
| JP | 2002-266022 | | 9/2002 |
| JP | 2002-363644 | | 12/2002 |
| KR | 100723201 | B1 | 5/2007 |
| KR | 100833047 | B1 | 5/2008 |
| KR | 20080040233 | A | 5/2008 |
| KR | 20090058058 | A | 6/2009 |
| KR | 20090071160 | A | 7/2009 |

HIGH-STRENGTH STEEL SHEET HAVING SUPERIOR TOUGHNESS AT CRYOGENIC TEMPERATURES, AND METHOD FOR MANUFACTURING SAME

CROSS REFERENCE TO RELATED APPLICATION

This application claims the benefit of International Patent Application No. PCT/KR2011/010156 entitled "High-Strength Steel Sheet Having Superior Toughness at Cryogenic Temperatures, and Method for Manufacturing Same", which claims priority to Korean Application No. 10-2010-0137340, filed Dec. 28, 2010, which are hereby incorporated by reference in their entirety.

TECHNICAL FIELD

The present invention relates to a high-strength steel sheet having superior toughness at cryogenic temperatures, and a method for manufacturing the same, and more particularly, to a high-strength steel sheet having superior impact toughness even when being applied as a structural steel for ships, offshore structures, or the like, or steels for multipurpose tanks, which will be exposed to extreme low temperature environments, and a method for manufacturing the same.

BACKGROUND ART

The use environment of structural steel materials, such as ships, offshore structures, or the like, or thick steel plates for multipurpose tanks storing various kinds of liquefied gases, such as carbon dioxide, ammonia, LNG, or the like is very severe. Therefore, the strength of such steel sheets is very important. To enhance strength, techniques that may enhance the hardness and strength of steel sheets by adding an hardenability enhancing element to form a low-temperature transformation phase within the steel sheet during the cooling thereof have been proposed.

However, when a low-temperature transformation phase, such as martensite, is formed inside steel sheets, toughness of the steel sheets may be severely deteriorated due to residual stress contained therein. That is, strength and toughness of steel sheets are two physical properties the compatibility of which may be difficult to realize, and it is generally understood that when the strength of steel sheets increases, the toughness thereof decreases.

In the case of the steel materials for offshore structures or the steel materials for tanks, the toughness thereof at low temperatures, as well as the strength thereof, is very important. First of all, environments in which steels for the formation of offshore structures have gradually moved to cold regions, such as the arctic, containing abundant petroleum resources below the seafloor, owing to resource depletion in relatively warm regions. Therefore, it is difficult for the existing high-strength steel sheets having superior toughness at low temperatures to endure an extreme low temperature environment that is severe as above.

Moreover, since thick steel sheets may be used for multipurpose tanks to store and transport liquefied gases having very low liquefied temperatures therein, the thick steel sheets should have a proper degree of toughness, even at a temperature lower than the temperature of the liquefied gas. For example, since the liquefied temperatures of acetylene and ethylene are −82° C. and −104° C., respectively, a high-strength steel sheet having superior toughness when exposed to such a temperature is required.

To secure a toughness required of steel sheets used for tanks, methods of controlling microstructures by adding 6 to 12% by weight of Ni or performing a treatment, such as quenching, tempering, or the like have been used, but such methods have limitations, such as a high manufacturing costs, and a low productivity.

In terms of low carbon steel, while existing steel sheets have superior toughness at a low temperature of about −60° C., it may be difficult for existing steel sheets to satisfy the requirements for steel sheets having superior low-temperature toughness, considering the extreme low temperature environments faced by ships, offshore structures, and the like. Therefore, it may be said that studies into high-strength steel sheets capable of securing superior toughness at extreme low temperatures lower than −60° C. are strongly required.

SUMMARY OF THE INVENTION

One aspect of the present invention provides a high strength steel sheet that has superior strength and may secure toughness at an extreme low temperature lower than −60° C. to enable the use thereof at the cryogenic temperature, and a method for manufacturing the same.

According to an aspect of the present invention, there is provided a high-strength steel sheet having superior toughness at extreme low temperatures, comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the high-strength steel sheet satisfies the condition of $[Mn]+5.4[Si]+26[Al]+32.8[Nb]<4.3$ where [Mn], [Si], [Al], and [Nb] indicate contents of Mn, Si, Al, and Nb in weight percentage, respectively.

The microstructure of the steel sheet may include, in area percentage, 99% or more of acicular ferrite, and 1% or less of austenite/martensite (M&A).

The microstructure may include 70% or more by area of effective grains having a grain boundary orientation not less than 15°, and may include 70% of more by area of effective grains having a size of not more than 10 μm.

The effective grains may have an average size in a range of 3-7 μm.

Also, the steel plate may have a tensile strength not less than 490 Mpa, a Charpy impact absorption energy not less than 300 J at −140° C., and a ductile-brittle transition temperature of not higher than −140° C.

According to another aspect of the present invention, there is provided a method for manufacturing a high-strength steel sheet having superior toughness at extreme low temperatures, the method comprising: a heating step of heating, in a temperature range of 1050-1180° C., a steel slab comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the steel slab satisfies the condition of $[Mn]+5.4[Si]+26[Al]+32.8[Nb]<4.3$ where [Mn], [Si], [Al], and [Nb] indicate contents of Mn, Si, Al, and Nb in weight percentage; a first rolling step of rolling the heated slab at a temperature not lower than an austenite recrystallization temperature (Tnr) with a number of passes not less than four; a second rolling step of performing finish rolling in a temperature range of $Ar_3$-Tnr; and performing a cooling.

The last two passes of the first rolling step may be performed at a reduction ratio of 15-25% per pass.

The second rolling step may be performed at a cumulative reduction ratio of 50-60%.

The cooling in the cooling step is performed to 320-380° C. at a cooling rate of 8-15° C./s from a point t/4 where t is the thickness of the steel sheet.

According to one aspect of the present invention, a steel sheet of the present invention may secure superior toughness and high strength not less than 490 Mpa for use as a structural steel for ships, offshore structures, or the like, or steels for tanks storing and carrying liquefied gases even in the cryogenic environment.

DETAILED DESCRIPTION OF THE INVENTION AND BEST MODE

Figure 1:
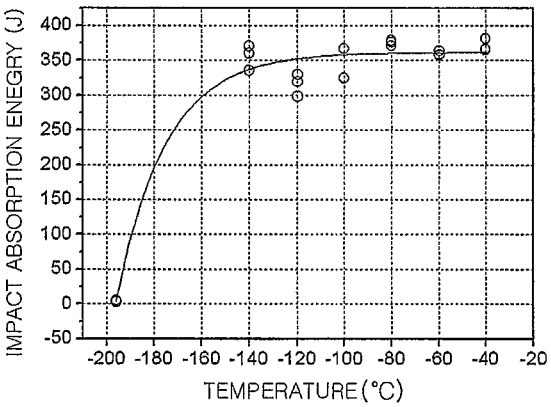
FIG. 1 is a graph showing variations of Charpy impact absorption energy with regard to temperatures of steel sheets according to an inventive example.

According to one aspect of the present invention, there is provided a high-strength steel sheet having superior toughness at extreme low temperatures, comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the high-strength steel sheet satisfies the condition of [Mn]+5.4[Si]+26[Al]+32.8[Nb]<4.3 where [Mn], [Si], [Al], and [Nb] indicate contents of Mn, Si, Al, and Nb in weight percentage, respectively.

First of all, the component system and composition range will be explained (weight percentage).

Carbon (C): 0.02-0.06%

C is the most important element in the strength and in the formation of a microstructure, and should be added in an amount not less than 0.02%. If the amount of carbon is excessive, however, low temperature toughness is reduced, and a MA structure is formed to cause the toughness of a welding heat affected zone to be reduced. Therefore, the upper limit of carbon is preferably set to 0.06%.

Silicon (Si): 0.1-0.35%

Si is an element added as a deoxidizer and is preferably added in an amount not less than 0.1%. If the amount of Si exceeds 0.35%, however, toughness and weldability are reduced. Therefore, the amount of Si is preferably controlled to be within a range of 0.1-0.35%.

Manganese (Mn): 1.0-1.6%

Mn is an element added so as to enhance the strength by solid solution strengthening and improve fineness of grains and toughness of a parent material, and is preferably added in an amount not less than 1.0% so as to sufficiently obtain such effects. However, when the added amount exceeds 1.6%, hardenability may increase, to reduce the toughness of a welded zone. Therefore, the added amount of Mn is preferably controlled to 1.0-1.6%.

Aluminum (Al): 0.02% or less (but not 0%)

Al is an element for effective deoxidization. However, since Al may only promote the formation of MA in a small amount, the upper limit of Al is set to 0.02%.

Nickel (Ni): 0.7-2.0%

Ni is an element that may enhance the strength and toughness of a parent material at the same time, and is preferably added in an amount not less than 0.7% so as to sufficiently obtain such effects. However, Ni is a relatively expensive element and an excessive addition of Ni may deteriorate weldability. Therefore, the upper limit of Ni is preferably set to 2.0%.

Copper (Cu): 0.3-0.9%

Cu is an element that may increase the strength of a parent material while minimizing a reduction in the toughness thereof by solid solution strengthening and precipitation strengthening, and is preferably added in an amount of about 0.3% so as to achieve a sufficient enhancement of strength. However, since an excessive addition of Cu may cause a surface failure, the upper limit of Cu is preferably set to 0.9%.

Titanium (Ti): 0.003-0.015%

Ti has an effect of forming a nitride with nitrogen (N) to make fine grains of HAZ, thereby improving HAZ toughness. To sufficiently obtain the improvement effect, Ti is preferably added in an amount not less than 0.003%. However, since an excessive addition of Ti may cause coarsening of the nitride to thus deteriorate low-temperature toughness, the amount of Ti is controlled to 0.015% or less. Therefore, the added amount of Ti is preferably controlled to be within a range of 0.003-0.015%.

Niobium (Nb): 0.003-0.02%

Nb is precipitated in the form of NbC or NbCN to greatly enhance the strength of a parent material and suppress the transformation of ferrite and bainite, thereby making fine grains. To sufficiently obtain the addition effect of Nb, Nb should be added in an amount not less than 0.003%. However, since an excessive addition of Nb may cause a reduction in HAZ toughness, the upper limit of Nb is preferably set to 0.02%.

Phosphorous (P): 0.01% or less (but not 0%)

Phosphorous is an element that is advantageous for strength enhancement and corrosion resistance. However, since phosphorous greatly reduces impact toughness, it is advantageous to limit the phosphorous content as much as possible. Therefore, the upper limit of phosphorus is preferably set to 0.01%.

Sulfur (S): 0.005% or less

Since sulfur forms MnS or the like to greatly reduce impact toughness, it is desirable to limit the sulfur content as much as possible such that the sulfur content does not exceed at least 0.005%.

Also, the component system further has to satisfy the condition of [Mn]+5.4[Si]+26[Al]+32.8[Nb]<4.3 where [Mn], [Si], [Al], and [Nb] indicate contents of Mn, Si, Al, and Nb, in weight percentage, respectively. Mn, Si, Al, and Nb are components that have influences on the formation of austenite/martensite (M&A) islands. If the value of [Mn]+5.4[Si]+26[Al]+32.8[Nb] is not less than 4.3, the components promote the formation of an M&A microstructure to thus reduce toughness at extreme low temperatures. Therefore, to secure toughness extreme low temperatures, it is necessary to satisfy the above conditions.

In this regard, the microstructure of the steel sheet may include 99% or more by area of acicular ferrite and 1% or less by area of austenite/martensite (M&A). First of all, the microstructure of the steel sheet provided in the present invention has acicular ferrite as a main structure, and austenite/martensite (M&A) islands as a secondary phase structure. Since the acicular ferrite enhances strength, whereas the austenite/martensite (M&A) islands reduce toughness, it is more desirable to restrict the secondary phase structure to be 1% or less.

Also, it is desirable that the effective grains having a grain boundary orientation not less than 15° are not less than 70% by area in the microstructure and the grains having a size of not more than 10 μm in the effective grains are not less than 70% by area. First, since the effective grains having a grain boundary orientation not less than 15° are a decisive factor that has an influence on the physical properties of steel, it is desirable that the effective grains be included in an amount not less than 70% by area in the microstructure.

Also, the grains having a size of not more than 10 μm in the effective grains that that have an important influence on the physical properties of steel are preferably included in an amount not less than 70% by area in the microstructure. This is because the grain size of the acicular ferrite has a close relationship with the impact toughness thereof, and as the grain size of the acicular ferrite decreases, impact toughness increases. Therefore, when the grains having a size not more than 10 μm in the effective grains are sufficiently included in an amount not less than 70% by area, the grains may be very advantageous in securing the toughness of steel.

In particular, the microstructure of a steel sheet according to the present invention may have the effective grains having an average grain size in a range of 3-7 μm. If the size of the effective grains is very finely controlled as above, the strength and toughness of the steel at a low temperature become advantageous and thus the steel sheet may be suitably used for offshore structures, and the like exposed to an extreme low temperature environment.

The steel sheet according to the present invention may have a tensile strength not less than 490 MPa, a Charpy impact absorption energy not less than 300 J at −140° C., and a ductile-brittle transition temperature (DBTT) not higher than −140° C. First of all, the strength of the steel sheet is not less than 490 MPa and is high to such a degree that may be used in the environment to which the steel sheet of the present invention is applied, and the Charpy impact absorption energy is not less than 300 J at an extreme low temperature of −140° C. so that the steel sheet may have superior cryogenic toughness.

Also, the ductile-brittle transition temperature (DBTT) is not higher than −140° C. and since embrittlement does not occur at −140° C., that is measurable by using current refrigerant, it is expected that embrittlement will occur at a temperature much lower than −140° C. Therefore, a high-strength steel sheet having superior cryogenic toughness may be obtained.

Meanwhile, according to another aspect of the present invention, there is provided a method for manufacturing a high-strength steel sheet having superior toughness at extreme low temperatures, the method comprising: a heating step of heating, in a temperature range of 1050-1180° C., a steel slab comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the high-strength steel sheet satisfies the condition of $[Mn]+5.4[Si]+26[Al]+32.8[Nb]<4.3$ where [Mn], [Si], [Al], and [Nb] indicate contents of Mn, Si, Al, and Nb, in weight percentage, respectively; a first rolling step of rolling the heated slab at a temperature not lower than an austenite recrystallization temperature (Tnr) with a pass number not less than four times; a second rolling step of performing finish rolling in a temperature range of $Ar_3$-Tnr; and a cooling step of performing a cooling.

In the method, the heating step of heating the steel slab having the above-mentioned composition in a temperature range of 1050-1180° C. is first performed. Since the heating step of the steel slab is a steel heating step for smoothly performing the subsequent rolling steps and sufficiently obtaining physical properties targeted for the steel sheet, it should be performed in a temperature range suitable for the purpose.

The heating step is important because the steel slab should be uniformly heated such that precipitation type elements in the steel sheet may be sufficiently dissolved, and excessive coarsening of grains due to the heating temperature should be sufficiently prevented. If the heating temperature of the steel slab is less than 1050° C., Nb, Ti, and the like are not redissolved in the steel, making it difficult to obtain a high-strength steel sheet, and partial recrystallization occurs to cause non-uniform austenite grains to be formed, making it difficult to obtain a high toughness steel sheet. Meanwhile, if the heating temperature exceeds 1180° C., austenite grains are excessively coarsened so that the grain size of the steel sheet increases and the toughness of the steel sheet is severely deteriorated. Therefore, the heat temperature of the steel slab is preferably controlled to the range of 1050-1180° C.

Next, after the heating of the slab, the step of rolling the slab is performed. To allow the steel sheet to have extreme low temperature toughness, austenite grains should exist in a fine size, made possible by controlling the rolling temperature and the reduction ratio. The rolling step of the present invention is characterized by being performed in two temperature ranges. Also, since the recrystallization behaviors in the two temperature ranges are different from each other, the rolling steps are set to have different conditions.

First, a first rolling step of rolling the slab at a temperature not lower than the austenite recrystallization temperature (Tnr) with a pass number not less than four times is performed. The rolling in the austenite recrystallization zone creates an effect to make fine grains through austenite recrystallization, and the fineness of the grains has an important influence on the enhancement in strength and toughness.

Particularly, the first rolling step is performed at a temperature not lower than the austenite recrystallization temperature (Tnr) by a multi-pass rolling not less than four times, in which last two passes are preferably performed at a reduction ratio of 15-25% per pass. That is, the present inventors recognized that the last two passes in the multipass rolling of the first rolling had a decisive influence on the grain size of austenite and the fineness of grains may be achieved through austenite recrystallization by performing the last two passes at a reduction ratio of 15-25% per pass, thereby completing the present invention. Also, in order to achieve the fineness of grains through a sufficient reduction, the total number of passes is at least four.

However, in order to prevent a large load from being applied to a roller, it is desirable to control the reduction ratio per pass to be 25% or less. Therefore, more preferably, multipass rolling in an amount not less than four passes is performed in the first rolling step in which the last two passes are performed at the reduction ratio of 15-25% per pass, thereby achieving enhancements in cryogenic toughness through fineness of grains and preventing an excessive load from being applied to a roller.

Next, the second rolling step of performing finish rolling in a temperature range of Ar3-Tnr is performed to further crush the grains and develop dislocations through inner deformation of the grains, thereby making easy a transformation to acicular ferrite during cooling. To generate such effects, the second rolling step is preferably performed at a cumulative reduction ratio not less than a total of 50%. However, since the cumulative reduction ratio exceeding 60% increases the limitation in reduction ratio of the first rolling step to hinder the achievement of sufficient grain fineness, it is more effective to restrict the cumulative reduction ratio to 50-60%.

The cooling in the cooling step is performed to 320-380° C. at a cooling rate of 8-15° C./s from a point t/4 where t is the thickness of the steel sheet. The cooling condition is a factor that has an influence on the microstructure. When the cooling is performed at a cooling rate of less than 8° C./s, the amount of M&A may be excessively increased to reduce strength and toughness, whereas when the cooling rate exceeds 15° C./s, cooling water may be excessively used to cause distortion of the steel sheet and thus make it impossible to control the shape of the steel sheet. Therefore, the cooling rate after rolling is preferably controlled to 8-15° C./s.

Also, the cooling temperature is preferably controlled to a temperature less than 380° C. such that an M&A structure is not created. However, when the cooling temperature is too low, the effect may be saturated, distortions may be caused in the steel sheet due to excessive cooling, and impact toughness may be reduced due to excessive increases in strength. Therefore, the lower limit of the cooling temperature is preferably set to 320° C.

Hereinafter, a detailed description will be made of the present invention by way of example, but the invention should not be construed as being limited to the examples set forth herein; rather, these examples are provided so that the disclosure will be thorough and complete.

EXAMPLES

Steel slabs having compositions listed in Table 1 were manufactured. Experimental formula in Table 1 indicates a value of [Mn]+5.4[Si]+26[Al]+32.8[Nb].

TABLE 1

| Item (wt %) | C | Si | Mn | P (ppm) | S (ppm) | Al | Ni | Ti | Nb | Cu | Experimental Formula |
|---|---|---|---|---|---|---|---|---|---|---|---|
| Inventive Steel 1 | 0.038 | 0.108 | 1.304 | 48 | 18 | 0.011 | 1.19 | 0.011 | 0.009 | 0.578 | 2.47 |
| Inventive Steel 2 | 0.04 | 0.11 | 1.32 | 50 | 17 | 0.012 | 1.21 | 0.01 | 0.01 | 0.496 | 2.55 |
| Inventive Steel 3 | 0.038 | 0.105 | 1.42 | 50 | 18 | 0.01 | 1.18 | 0.011 | 0.012 | 0.6 | 2.64 |
| Comparative Steel 1 | 0.08 | 0.12 | 1.25 | 50 | 18 | 0.011 | 1.21 | 0.011 | 0.01 | 0.62 | 2.51 |
| Comparative Steel 2 | 0.037 | 0.11 | 1.32 | 50 | 17 | 0.013 | 1.21 | 0.012 | 0.001 | 0.587 | 2.28 |
| Comparative Steel 3 | 0.04 | 0.11 | 1.302 | 48 | 17 | 0.012 | 1.17 | 0.01 | 0.012 | 0.021 | 2.60 |
| Comparative Steel 4 | 0.042 | 0.13 | 1.305 | 47 | 18 | 0.035 | 1.16 | 0.01 | 0.011 | 0.595 | 3.28 |
| Comparative Steel 5 | 0.04 | 0.106 | 1.81 | 50 | 18 | 0.011 | 1.22 | 0.012 | 0.011 | 0.61 | 3.03 |

The steel slabs were subject to a first rolling (roughing mill), a second rolling (finishing mill), and cooling under the conditions listed in Table 2.

TABLE 2

| | | Roughing Mill Condition | | | Finishing Mill Condition | | | Cooling Condition | | |
|---|---|---|---|---|---|---|---|---|---|---|
| Kinds of steel | No. | Heating Temp. (° C.) | Roughing Mill End Temp. (° C.) | Reduction Ratio in last two stages (%) | Rolling Start Temp. (° C.) | Rolling End Temp. (° C.) | Cumulative Reduction Ratio (%) | Cooling Start Temp. (° C.) | Cooling End Temp. (° C.) | Cooling Rate (° C./s |
| Inventive Steel 1 | 1-1 | 1085 | 1066 | 15.2/19.6 | 773 | 765 | 60 | 730 | 330 | 12.5 |
| | 1-2 | 1088 | 1059 | 16.3/21.5 | 780 | 775 | 60 | 732 | 342 | 11.8 |
| | 1-3 | 1090 | 1068 | 16.2/23.4 | 778 | 762 | 55 | 738 | 329 | 13.1 |
| | 1-4 | 1088 | 1068 | 12.5/14.2 | 776 | 765 | 60 | 735 | 338 | 12.5 |
| | 1-5 | 1086 | 1066 | 18.4/24.2 | 778 | 768 | 60 | 734 | 453 | 13.4 |
| | 1-6 | 1079 | 1060 | 16.2/22.8 | 779 | 770 | 60 | 738 | 341 | 6.4 |
| Inventive Steel 2 | 2-1 | 1092 | 1069 | 18.5/20.0 | 782 | 770 | 60 | 735 | 335 | 11.8 |
| | 2-2 | 1092 | 1068 | 17.8/21.4 | 772 | 765 | 52 | 735 | 332 | 12.2 |
| | 2-3 | 1088 | 1064 | 19.5/22.5 | 776 | 759 | 60 | 738 | 352 | 13.2 |
| | 2-4 | 1086 | 1065 | 12.1/13.5 | 775 | 758 | 60 | 736 | 345 | 12.5 |
| | 2-5 | 1100 | 1070 | 18.5/21.2 | 773 | 762 | 60 | 738 | 406 | 11.8 |
| | 2-6 | 1083 | 1064 | 20.1/23.5 | 775 | 762 | 60 | 740 | 350 | 5.8 |
| Inventive Steel 3 | 3-1 | 1084 | 1068 | 18.6/23.2 | 776 | 763 | 60 | 742 | 336 | 9.8 |
| | 3-2 | 1088 | 1066 | 17.2/21.3 | 769 | 759 | 52 | 735 | 345 | 11.5 |
| | 3-3 | 1093 | 1065 | 15.8/24.3 | 768 | 757 | 58 | 734 | 338 | 12.5 |
| | 3-4 | 1095 | 1059 | 11.5/13.2 | 775 | 758 | 60 | 734 | 365 | 12.6 |
| | 3-5 | 1085 | 1066 | 18.5/22.1 | 772 | 762 | 60 | 742 | 415 | 12.4 |
| | 3-6 | 1088 | 1065 | 17.8/23.5 | 776 | 763 | 60 | 734 | 348 | 6.8 |

TABLE 2-continued

| Kinds of steel | No. | Roughing Mill Condition: Heating Temp. (° C.) | Roughing Mill Condition: Roughing Mill End Temp. (° C.) | Roughing Mill Condition: Reduction Ratio in last two stages (%) | Finishing Mill Condition: Rolling Start Temp. (° C.) | Finishing Mill Condition: Rolling End Temp. (° C.) | Finishing Mill Condition: Cumulative Reduction Ratio (%) | Cooling Condition: Cooling Start Temp. (° C.) | Cooling Condition: Cooling End Temp. (° C.) | Cooling Condition: Cooling Rate (° C./s |
|---|---|---|---|---|---|---|---|---|---|---|
| Comparative Steel 1 | 4-1 | 1096 | 1064 | 17.3/21.8 | 780 | 768 | 60 | 735 | 345 | 11.5 |
| | 4-2 | 1079 | 1064 | 19.2/24.1 | 781 | 765 | 60 | 730 | 335 | 12.2 |
| | 4-3 | 1080 | 1068 | 20.3/21.5 | 775 | 765 | 60 | 735 | 338 | 12.4 |
| | 5-1 | 1085 | 1062 | 20.8/23.5 | 776 | 762 | 60 | 739 | 335 | 11.7 |
| | 5-2 | 1086 | 1065 | 18.8/19.6 | 779 | 760 | 60 | 734 | 345 | 13.2 |
| | 5-3 | 1092 | 1064 | 18.4/19.8 | 772 | 765 | 60 | 735 | 356 | 9.9 |
| Comparative Steel 2 | 6-1 | 1095 | 1068 | 17.2/22.9 | 773 | 768 | 60 | 736 | 365 | 10.5 |
| | 6-2 | 1096 | 1070 | 16.5/23.5 | 769 | 759 | 60 | 732 | 355 | 11.5 |
| | 6-3 | 1086 | 1062 | 20.8/21.7 | 781 | 765 | 60 | 735 | 345 | 11.7 |
| Comparative Steel 3 | 7-1 | 1085 | 1065 | 17.8/23.5 | 775 | 762 | 60 | 740 | 365 | 12.2 |
| | 7-2 | 1085 | 1063 | 19.6/19.8 | 776 | 768 | 60 | 734 | 355 | 12.8 |
| | 7-3 | 1089 | 1072 | 20.5/23.5 | 774 | 764 | 60 | 731 | 345 | 11.6 |
| Comparative Steel 4 | 8-1 | 1902 | 1065 | 21.5/22.5 | 772 | 766 | 60 | 735 | 339 | 10.9 |
| | 8-2 | 1096 | 1068 | 18.8/23.8 | 775 | 765 | 60 | 736 | 335 | 13.4 |
| | 8-3 | 1087 | 1067 | 22.3/23.1 | 776 | 765 | 60 | 735 | 354 | 12.2 |

Yield strength (YS), tensile strength (TS), Charpy impact absorption energy (CVN) at −100° C., −120° C., and −140° C., ductile-brittle transition temperature (DBTT) of the manufactured steel sheets were measured and the measurement results are shown in Table 3.

TABLE 3

| Types of steel | No. | YS (Mpa) | TS (Mpa) | CVN at −100° C. (J) | CVN at −120° C. (J) | CVN at −140° C. (J) | DBTT (° C.) |
|---|---|---|---|---|---|---|---|
| Inventive Steel 1 | 1-1 | 469 | 549 | 416 | 386 | 384 | −140 or less |
| | 1-2 | 476 | 548 | 396 | 375 | 386 | −140 or less |
| | 1-3 | 468 | 547 | 424 | 416 | 406 | −140 or less |
| | 1-4 | 454 | 516 | 183 | 46 | 12 | −98 |
| | 1-5 | 434 | 486 | 162 | 104 | 26 | −114 |
| | 1-6 | 453 | 508 | 364 | 323 | 62 | −125 |
| Inventive Steel 2 | 2-1 | 481 | 521 | 423 | 384 | 364 | −140 or less |
| | 2-2 | 490 | 533 | 395 | 388 | 386 | −140 or less |
| | 2-3 | 480 | 517 | 394 | 346 | 354 | −140 or less |
| | 2-4 | 475 | 511 | 126 | 26 | 4 | −102 |
| | 2-5 | 456 | 476 | 246 | 106 | 32 | −110 |
| | 2-6 | 465 | 486 | 369 | 214 | 21 | −125 |
| Inventive Steel 3 | 3-1 | 463 | 537 | 384 | 374 | 351 | −140 or less |
| | 3-2 | 445 | 534 | 365 | 354 | 338 | −140 or less |
| | 3-3 | 484 | 523 | 435 | 413 | 393 | −140 or less |
| | 3-4 | 461 | 527 | 46 | 21 | 12 | −87 |
| | 3-5 | 438 | 475 | 135 | 36 | 12 | −98 |
| | 3-6 | 441 | 488 | 118 | 24 | 10 | −91 |
| Comparative Steel 1 | 4-1 | 488 | 564 | 48 | 24 | 8 | −86 |
| | 4-2 | 492 | 572 | 68 | 26 | 5 | −84 |
| | 4-3 | 495 | 568 | 58 | 18 | 6 | −80 |
| | 5-1 | 421 | 472 | 428 | 425 | 346 | −140 or less |
| | 5-2 | 425 | 475 | 425 | 435 | 384 | −140 or less |
| | 5-3 | 431 | 468 | 415 | 426 | 368 | −140 or less |
| Comparative Steel 2 | 6-1 | 458 | 496 | 386 | 347 | 326 | −140 or less |
| | 6-2 | 439 | 482 | 406 | 407 | 389 | −140 or less |
| | 6-3 | 452 | 503 | 395 | 356 | 345 | −140 or less |
| Comparative Steel 3 | 7-1 | 468 | 521 | 365 | 120 | 15 | −112 |
| | 7-2 | 489 | 548 | 246 | 86 | 12 | −108 |
| | 7-3 | 469 | 552 | 114 | 75 | 13 | −97 |
| Comparative Steel 4 | 8-1 | 496 | 565 | 168 | 45 | 12 | −106 |
| | 8-2 | 492 | 575 | 75 | 18 | 8 | −78 |
| | 8-3 | 495 | 552 | 124 | 24 | 12 | −95 |

First, in the case of Nos. 1-1 to 1-3, 2-1 to 2-3, and 3-1 to 3-3, since inventive steels were used, the reduction ratio of each of the last two passes in roughing mill was 15-250, the cumulative reduction ratio in finishing mill was 50-60%, the cooling rate in the cooling condition was 8-15° C./s, and the cooling temperature was 320-380° C., those steels satisfied the conditions of the present invention. As a result, it is shown that yield strength was 440 MPa or more, tensile strength was 490 MPa or more, and Charpy impact absorption energy at −100° C., −120° C., and −140° C. was all 300 J or more, considered to have very superior cryogenic toughness. Also, since embrittlement did not occur at −140° C. which was the lowest measurement temperature, it may be seen that DBTT has a temperature much lower than −140° C.

Meanwhile, in the case of Nos. 1-4, 2-4, and 3-4, although inventive steels were used, since the reduction ratio of each of the last two passes was less than 15%, the fineness of grains was not achieved, Charpy impact absorption energy was very low, and DBTT was very high. From this result, it may be seen that the steels of Nos. 1-4, 2-4, and 3-4 are not very good in cryogenic toughness.

In the case of Nos. 1-5, 2-5, and 3-5, although inventive steels were used, since the cooling temperature was higher than 380° C., it is considered that a considerable amount of MA structure was formed. Also, it may be seen that the low temperature toughness of Nos. 1-5, 2-5, and 3-5 is not very good from very low Charpy impact absorption energy and high DBTT.

In the case of Nos. 1-6, 2-6, and 3-6, although inventive steels were used, since the cooling rate was too low, it is considered that a considerable amount of MA structure was formed. Also, it may be seen that the low temperature toughness of Nos. 1-6, 2-6, and 3-6 is not very good from very low Charpy impact absorption energy and high DBTT.

FIG. 1 is a graph showing variations in Charpy impact absorption energy with regard to temperature when inventive steels were used and the manufacturing conditions were within the range of the present invention. It may be confirmed that the cryogenic toughness is very superior from high energy values not less than 300 J at −140° C., the lowest temperature that is measurable at −40° C.

Figure 2:
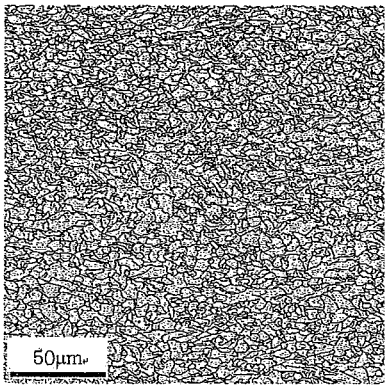
FIG. 2 is a photograph of a steel sheet microstructure according to an inventive example.

FIG. 2 is a microstructure photograph of steel according to an inventive example, in which black grains indicate effective grains having a grain boundary orientation not less than 15°. It may be confirmed from FIG. 2 that the effective grains was 70% by area and acicular ferrite was 99% or more by area.

The invention claimed is:

1. A high-strength steel sheet having superior toughness at extreme low temperatures, comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the high-strength steel sheet satisfies the condition of [Mn]+5.4[Si]+26[Al]+32.8[Nb]<4.3 where [Mn], [Si], [Al], and [Nb] indicate contents of Mn, Si, Al, and Nb in weight percentage, respectively, wherein microstructure of the steel sheet comprises, in area percentage, 99% or more of acicular ferrite and 1% or less austenite/martensite (M&A).

2. The high-strength steel sheet of claim 1, wherein effective grains having a grain boundary orientation not less than 15° are not less than 70% in area percentage in the microstructure and the grains having a size of not more than 10 μm in the effective grains are not less than 70% in area percentage.

3. The high-strength steel sheet of claim 2, wherein the effective grains have an average size in a range of 3-7 μm.

4. The high-strength steel sheet of claim 3, wherein the steel plate has a tensile strength not less than 490 Mpa, a Charpy impact absorption energy not less than 300 J at −140° C., and a ductile-brittle transition temperature of not higher than −140° C.

5. A method for manufacturing a high-strength steel sheet having superior toughness at extreme low temperatures, the method comprising:

a heating step of heating, in a temperature range of 1050-1180° C., a steel slab comprising, in weight percentage, 0.02 to 0.06% of C, 0.1 to 0.35% of Si, 1.0 to 1.6% of Mn, 0.02% or less (but not 0%) of Al, 0.7 to 2.0% of Ni, 0.4 to 0.9% of Cu, 0.003 to 0.015% of Ti, 0.003 to 0.02% of Nb, 0.01% or less of P, 0.005% or less of S, the remainder being Fe and unavoidable impurities, wherein the high-strength steel sheet satisfies the condition of [Mn]+5.4[Si]+26[Al]+32.8[Nb]<4.3 where [Mn], [Si], [Al], and [Nb] indicate contents of Mn, Si, Al, and Nb in weight percentage;

a rolling step of rolling the steel slab to form a steel sheet at a temperature not lower than the austenite recrystallization temperature (Tnr) with a number of passes not less than four, wherein the last two passes of the first rolling step are performed at a reduction ratio of 15-25% per pass;

a second rolling step of performing finish rolling in a temperature range of Ar3-Tnr; and a cooling step of cooling the rolled steel sheet, wherein microstructure of the rolled steel sheet comprises, in area percentage, 99% or more of acicular ferrite and 1% or less austenite/martensite (M & A).

6. The method of claim 5, wherein a cumulative reduction ratio in the second rolling step is a total of 50-60%.

7. The method of claim 5, wherein the cooling in the cooling step is performed to 320-380° C. at a cooling rate of 8-15° C./s from a point t/4 where t is the thickness of the steel sheet.

8. The method of claim 5, wherein the cooling in the cooling step is performed to 320-380° C. at a cooling rate of 8-15° C./s from a point t/4 where t is the thickness of the steel sheet.

9. The method of claim 6, wherein the cooling in the cooling step is performed to 320-380° C. at a cooling rate of 8-15° C./s from a point t/4 where t is the thickness of the steel sheet.

* * * * *